US005911178A

United States Patent [19]

Alexander

[11] Patent Number: 5,911,178

[45] Date of Patent: Jun. 15, 1999

[54] SPACIAL WORK-IN-PROGRESS ORGANIZER

[75] Inventor: Brian D. T. Alexander, Holland, Mich.

[73] Assignee: Haworth, Inc., Holland, Mich.

[21] Appl. No.: 08/983,428

[22] PCT Filed: Jun. 5, 1997

[86] PCT No.: PCT/US97/10571

§ 371 Date: Dec. 31, 1997

§ 102(e) Date: Dec. 31, 1997

[87] PCT Pub. No.: WO97/46142

PCT Pub. Date: Dec. 11, 1997

Related U.S. Application Data

[60] Provisional application No. 60/019,423, Jun. 7, 1996.

[51] Int. Cl.[6] ..... A47B 35/00

[52] U.S. Cl. ..... 108/50.11; 108/50.01

[58] Field of Search ..... 108/50.11, 27, 108/28, 29, 60, 61, 50.02, 50.01; 248/441.1, 299.1, 298.1, 206.1; 211/43, 162

[56] References Cited

U.S. PATENT DOCUMENTS

| | | | |
|---|---|---|---|
| 510,468 | 12/1893 | Buehl . | |
| 808,318 | 12/1905 | Thomas et al. . | |
| 1,013,784 | 1/1912 | Kugel . | |
| 1,212,588 | 1/1917 | Volhard . | |
| 1,539,042 | 5/1925 | Dennis . | |
| 1,783,278 | 2/1930 | Brady . | |
| 1,898,666 | 2/1933 | Isaacson | 108/27 X |
| 2,156,025 | 4/1939 | Paul . | |
| 2,480,233 | 8/1949 | Fuller | 108/27 X |
| 2,510,198 | 6/1950 | Tesmer . | |
| 3,366,415 | 1/1968 | Cooper | 108/50.11 X |
| 4,569,498 | 2/1986 | Ermanski . | |
| 4,852,500 | 8/1989 | Ryburg et al. | 108/50.01 X |
| 4,879,955 | 11/1989 | Moll et al. | 108/50.02 |
| 5,520,292 | 5/1996 | Lombardi | 248/298.1 X |
| 5,522,323 | 6/1996 | Richard . | |
| 5,704,298 | 1/1998 | Corpuz, Jr. et al. | 108/50.01 |

FOREIGN PATENT DOCUMENTS 10 209 of 1914 United Kingdom .

*Primary Examiner*—Jose V. Chen

*Attorney, Agent, or Firm*—Flynn, Thiel, Boutell & Tanis, P.C.

[57] ABSTRACT

A spacial organizer for display and organization of documents. The organizer comprises a horizontally elongate support rail supported in upwardly spaced relation above a floor. A plurality of supporting assemblies are removably mounted on the rail for permitting documents and things to be removably positioned thereon. The supporting devices include a first assembly having a generally L-shaped handling member which permits a document to be removably supported thereon, and include a second assembly having a spring clip for engaging an edge of a document. The supporting devices each include an elongate support arm assembly which at one end has a clamp structure for releasable engagement with the support rail for positionally adjustable mounting thereon.

9 Claims, 5 Drawing Sheets

FIG. 9
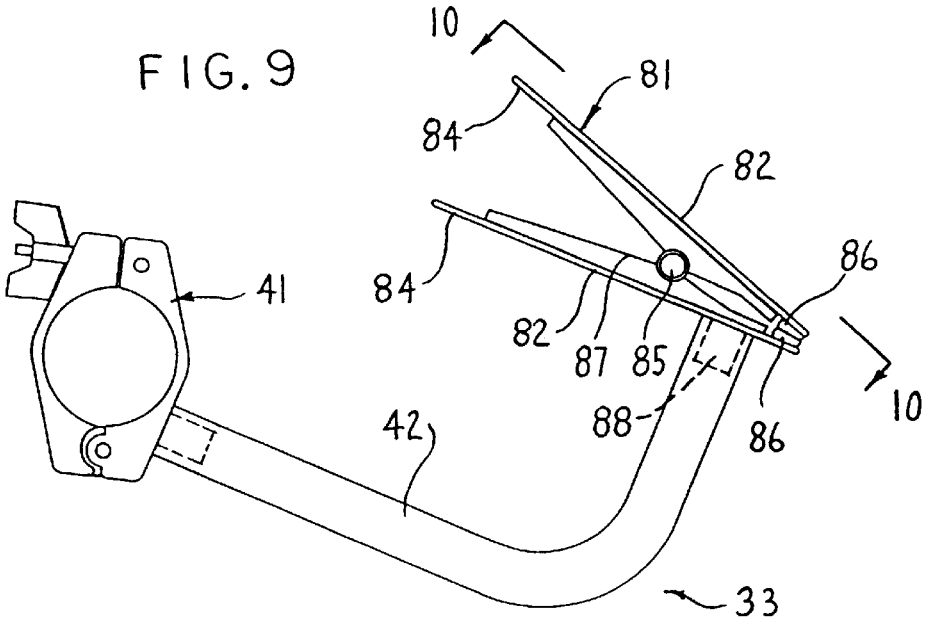
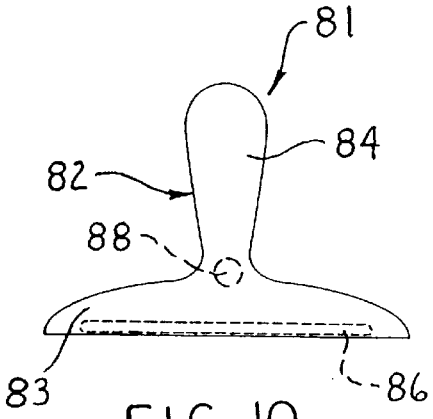
FIG. 10
FIG. 11
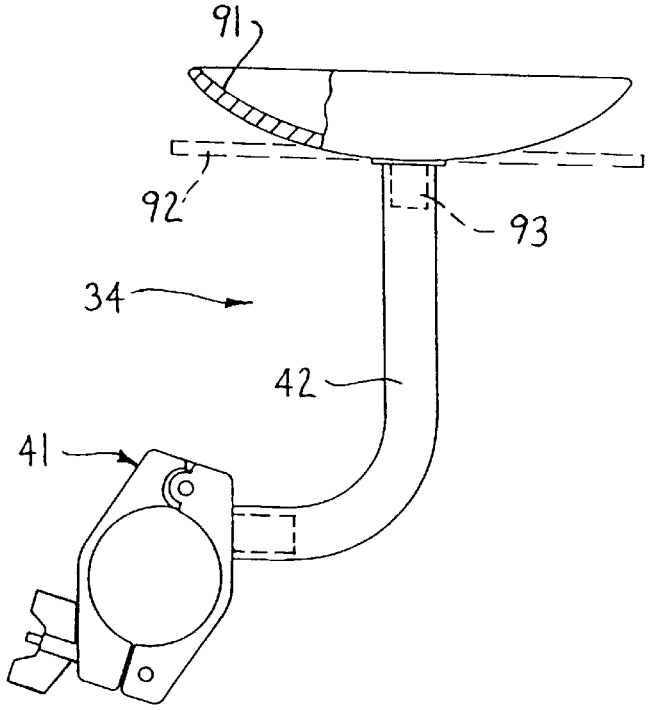

SPACIAL WORK-IN-PROGRESS ORGANIZER

This application claims the benefit of U.S. Provisional Application Ser. No. 60/019,423 filed Jun. 7, 1996.

FIELD OF THE INVENTION

This invention relates to a furniture structure for use in an office-type environment and, more specifically, relates to a spacial organizing structure which is particularly desirable for permitting a worker to organize a significant number of work-in-progress papers or documents, particularly in close proximity to a worksurface such as a table, while providing both visual and physical access to the documents but without occupying or interfering with efficient use of the main worksurface or table top.

BACKGROUND OF THE INVENTION

In an office-type environment, workers today are more frequently being provided with workspaces which are more open, with the workspace typically being defined by free-standing furniture, rather than being closely enclosed by panels and the like. The openness of modern workstations, and the ever increasing need to handle and organize large numbers of papers or documents, makes not only document management difficult, but also interfere with efficient utilization of available working surface area as defined on tables, desks and the like. In fact, the actual working surface area defined on the tops of tables and desks is often cluttered by various stacks of documents, and thus the actual working area often becomes reduced to an undesirably small amount.

The present invention relates to a spacial work-in-progress organizer which attempts to address the above problem, and which permits a worker to support a plurality of documents or papers in a spacial arrangement which more efficiently utilizes both horizontal and vertical space, particularly such space as disposed adjacent a primary worksurface or table, without requiring direct use of the upper working surface of the table or desk. The spacial organizer of the present invention enables a plurality of documents or papers, or related things and objects, to be supported in horizontally and vertically spaced relation both adjacent and along an edge of a main worksurface, such as the top of a table or desk, with the spacial organizer supporting the documents, papers or things so that they are both visible and readily accessible to the user of the table, but at the same time the objects or things are maintained in spaced relation from the upper working surface of the table so as to not interfere with the efficient or proper usage thereof by the user. At the same time, the user can be carrying out work on or in conjunction with the upper working surface of the table, but still have visual and physical access to numerous documents and things which are mounted on the spacial organizer, which documents themselves can be organized in a desired sequence or positional arrangement, to assist the user with respect to his work-in-progress.

In the spacial organizer of the present invention, there is provided a horizontally elongate support rail which is supported in upwardly spaced relation from the floor, with the support rail preferably being positioned adjacent but spaced somewhat horizontally away from and upwardly relative to an adjacent edge of a table top or the like. The support rail permits a plurality of different types of document or object supporting devices to be removably but adjustably positioned thereon, both vertically and horizontally, so as to be movable both toward and away from, and up and down, relative to the table top, and also longitudinally along the rail. The supporting devices include a generally L-shaped holder which is positionable in a generally upright position to permit papers or like documents to be supported thereon. The supporting devices also include a clip which includes opposed spring-closed jaws which permit gripping of a paper or other thing therebetween. The supporting devices further include a tray or dish which permits objects, things or documents to be supported thereon. The supporting devices also include a markerboard which is adapted for mounting on one of the holders, which markerboard permits use with conventional erasable marking pens. The supporting devices also include a paper hanging rail for permitting larger papers or documents to be suspended therefrom. The support rail also permits other objects, such as a light or the like, to be mounted thereon.

Other objects and purposes of the invention will be apparent to persons familiar with the environment of the present invention upon reading the following specification and inspecting the accompanying drawings.

BRIEF DESCRIPTION OF THE DRAWINGS

FIG. 9 is a side elevational view of a further supporting device known as a clip assembly.

FIG. 10 is a view taken generally along line 10—10 in FIG. 9.

FIG. 11 is a side elevational view of a further supporting device known as a dish or tray assembly.

Figure 1:
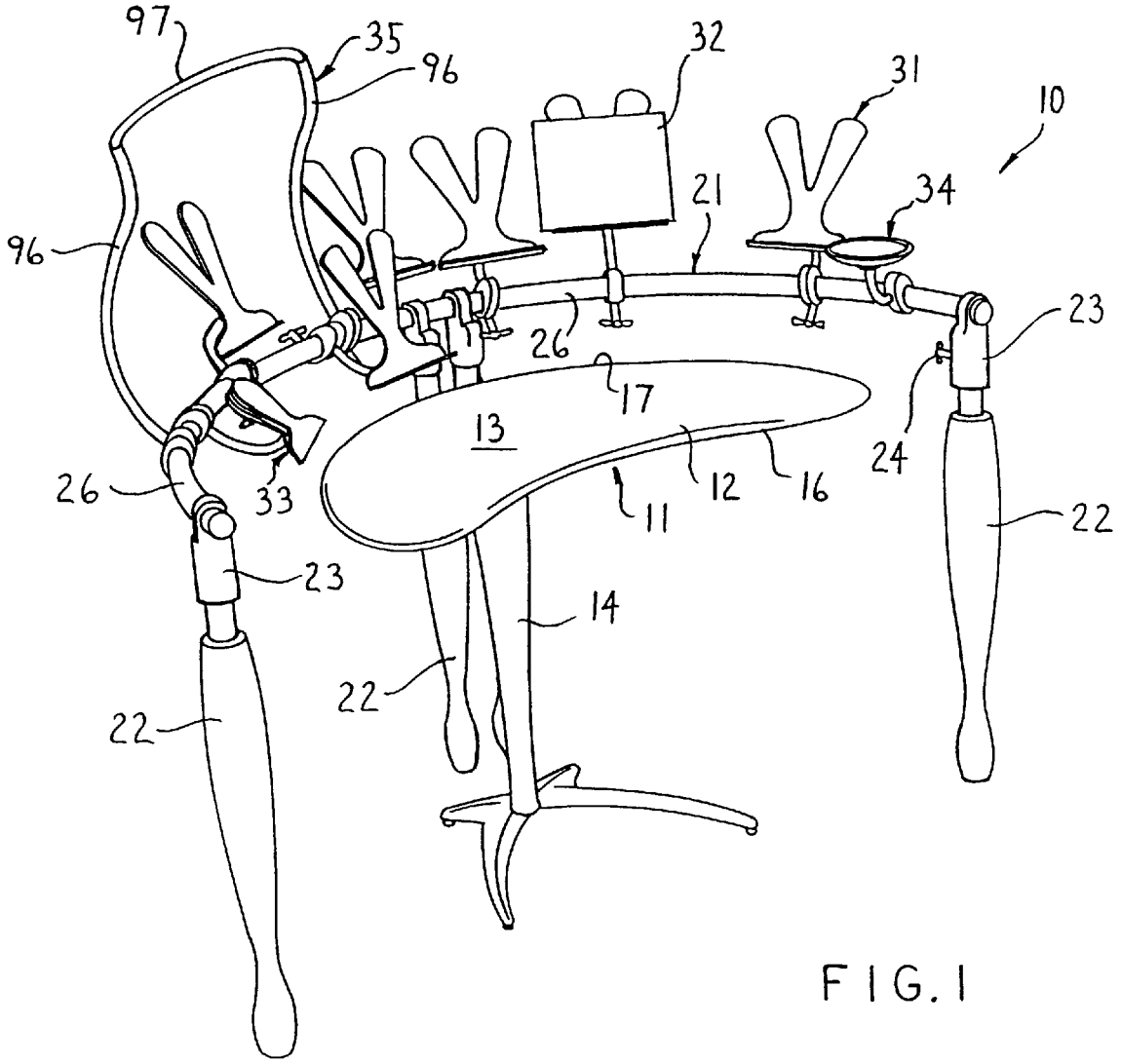
FIG. 1 is a perspective view of the spacial work-in-progress organizer of the present invention, such organizer being illustrated in conjunction with a table.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. The word "forward" will refer to a position or direction adjacent the user, and the word "rearward" will refer to a position or direction which is remote from the user. Said terminology will include the words specifically mentioned, derivatives thereof, and words of similar import.

DETAILED DESCRIPTION

Figure 2:
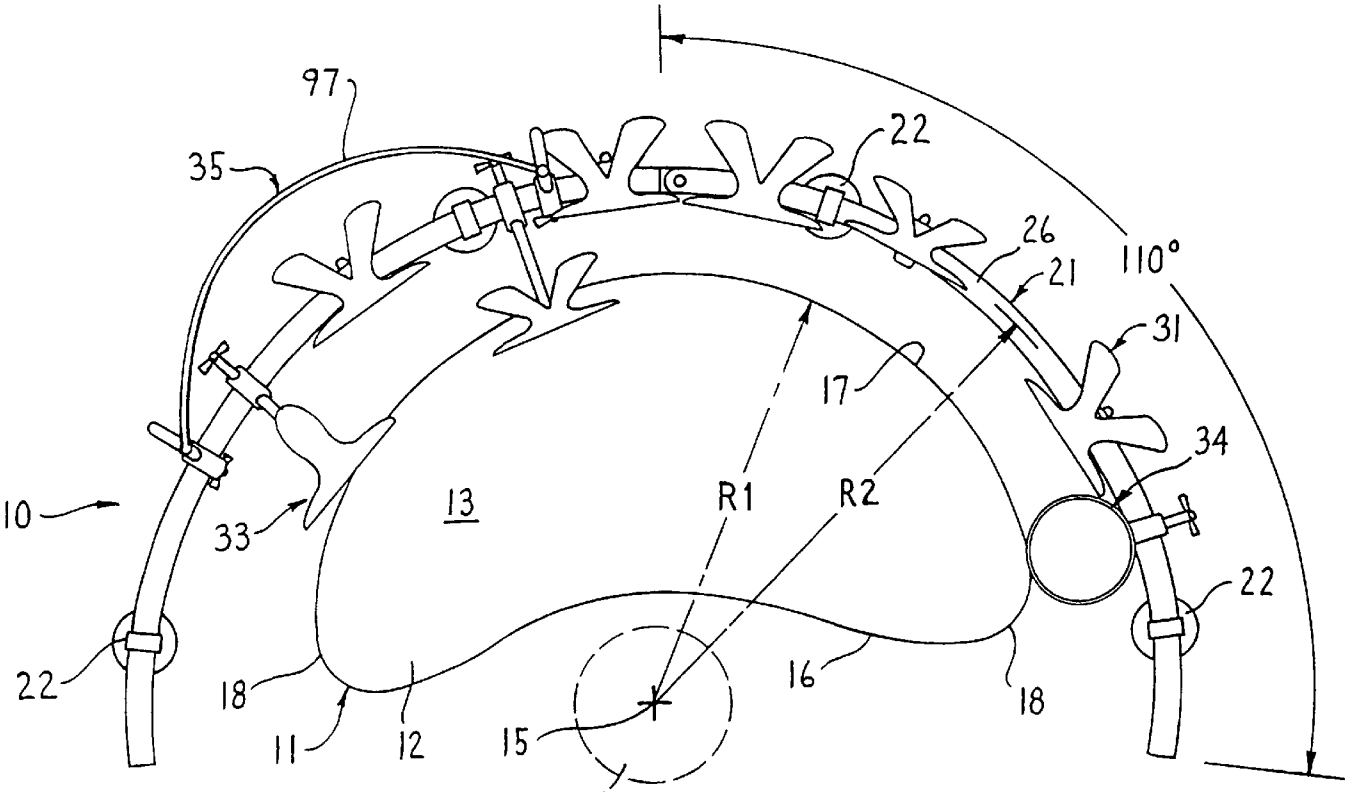
FIG. 2 is a plan view which generally corresponds to the arrangement of FIG. 1.

Referring to FIGS. 1 and 2, there is illustrated a spacial work-in-progress organizer 10 according to the present invention. The spacial organizer 10 is illustrated in FIGS. 1 and 2 for use in conjunction with an article of office furniture 11, namely a table.

In the illustrated arrangement, the table 11 includes a worksurface or top 12 defining thereon a generally horizontally enlarged and substantially planar upper working surface 13. A leg structure 14 is fixed to the top 12 and projects downwardly for supportive engagement with a floor. The top 12 in the illustrated embodiment is provided with a generally banana-shaped profile defined between front and rear edges 16 and 17 and interconnected through convexly rounded end edges 18. The front edge 16 is of a shallow concave arcuate curvature, and the rear edge 17 is also of a shallow but convex arcuate curvature. This configuration enables and facilitates a user to position himself adjacent the front edge 16 of the table, such as in a region diagrammatically indicated at 19 in FIG. 2. In addition, the rear edge 17 may be generated on a radius or curvature R1 which has a centerpoint 15 located generally within the user region 19 to facilitate the ability of the user to access the entirety of the upper working surface 13.

Considering now the spacial organizer 10, same includes a generally horizontally elongate support rail or element 21 which is maintained in upwardly spaced and generally parallel relation above the floor by a plurality of upright support legs 22. Each upright leg 22, at an upper end thereof, has a rod part which vertically slidably telescopes into a lower tubular portion of a mounting collar 23, the latter having an opening extending horizontally therethrough for permitting insertion of rail 21 thereinto and permitting the mounting collar 23 to be selectively positioned on the support rail 21. The collar 23 can be suitably fixed to the support rail in any conventional manner, such as by a set screw (not shown) or the like. Further, the mounting collar 23 in the illustrated embodiment is provided with a clamping fastener 24, such as a thumb screw, which enables the upper portion of leg 22 to have a limited vertical telescopic adjustment within the lower tubular part of mounting collar 23 to permit limited height adjustment with respect to the support rail 21.

Figure 3:
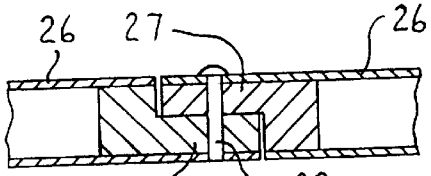
FIG. 3 is an enlarged fragmentary sectional view illustrating the connection between the two sections of the support rail.

In the illustrated embodiment, support rail 21 is defined by a pair of horizontally elongate rail sectors 26 each being defined by an elongate tubular element. The adjacent ends of the rail sections 26 are provided with axially projecting and overlapping half sections 27 (FIG. 3) which are connected by a generally vertically extending hinge pin 28. This enables the angular relationship between the sections 26 to be adjusted if desired, and also enables the two sections 26 to be swingably collapsed into a position closely adjacent one another for storage purposes, if desired.

In the illustrated embodiment, each rail sector 26 has two of the legs 22 mounted, adjacent opposite ends thereof for supportive engagement on the floor. However, it will be appreciated that the rail 21 can either be formed in one continuous piece, or from multiple elongate sectors if desired, and the number of such sectors as well as the number of support legs 22 can obviously vary depending upon the overall structural, functional and aesthetic requirements.

The support legs 22 are sized so as to normally position the support rail 21 at an elevation which is preferably slightly above the elevation of the upper working surface 13, such upward vertical spacing of the support rail 21 being illustrated in FIG. 1. This facilitates both visual and physical access to the support rail 21 and to the supporting devices mounted thereon, even when the user is disposed in the region 19 adjacent the front edge 16.

As shown by FIG. 2, the support rail 21 is also of a generally arcuate configuration when viewed in a horizontal plane, which arcuate configuration in the illustrated embodiment is preferably generated on a substantially constant radius R2 which is also generated about a centerpoint similar to or approximately corresponding to the centerpoint 15. The radius R2, however, is sufficiently greater than the radius R1 so as to result in the support rail 21 being positioned so as to be disposed rearwardly a predetermined but substantially uniform distance away from the rear table edge 17. The support rail 21 extends longitudinally along and in generally parallel relationship with the rear table edge 17 over some or all of the length thereof. In the illustrated embodiment, the overall arcuate extent of the support rail 21 preferably is such as to define a generally channel-shaped or half-circle configuration when viewed in a horizontal plan view, and in the illustrated embodiment the rail 21 extends through an angle which will preferably be in the range of from about 180° to about 220°, with each of the sectors 26 extending through one-half of this arcuate extent.

The spacial organizer 10 includes a plurality of different supporting devices which adjustably mount on the support rail 21 for permitting various papers, documents, things or objects to be stationarily supported in adjacent locations around the main work top 12. Examples of various types of supporting devices usable with support rail 21 includes a holder assembly 31 which permits papers or documents to be removably supported thereon, a markerboard assembly 32 which removably mounts on one of the holder assemblies 31, a clip assembly 33 which permits releasable engagement with an edge of a paper or the like, a tray or dish assembly 34 which permits objects or things to be supported therein or thereon, and a hanging rail assembly 35 which permits papers, especially large papers, to be suspended therefrom. These various supporting assemblies 31–35 are described below.

Many of the supporting devices, including specifically the holder assembly 31, the clip assembly 33 and the dish assembly 34, employ a manually releasable clamp 41 (FIG. 4) for supportive engagement with the support rail 21. This clamp 41 in turn connects to one end of an elongate support arm 42 which is preferably flexible and projects transversely outwardly away from the support rail for connection at its other end to an appropriate support member.

The removable clamp 41 is formed as a split collar-type clamp defined by collar halves 43 and 44 which, when in a closed and opposed relationship, define a generally cylindrical opening 45 sized so as to permit clamping engagement around the support rail 21. The collar halves 43 and 44 adjacent one end thereof are hingedly connected by a suitable hinge pin 46. The other ends of the collar halves 43 and 44 are respectively provided with slots 47 and 48 extending therethrough in perpendicular relation to the axis of hinge pin 46 so that these ends of the collar halves have a generally forked or bifurcated construction. A manual actuator 49 cooperates between the ends of the collar halves remote from the hinge pin 46, which manual actuator includes an elongate rod 51 having an enlarged head 52 fixed thereto, which head 52 is disposed within the slot 47 and is provided with a transversely projecting hinge pin 53 which is rotatably supported by the side walls of the collar half 43. The rod 51 is adapted to project downwardly through the slot 48 defined in the other collar half 44, and the lower end of the rod 51 is threaded and has a rotatable clamp nut 54 engaged therewith, the latter having an inner truncated conical surface 55 which is disposed adjacent and opposed to a similarly sloped side surface 56 formed on the bifurcated end of the collar half 44. When the manual actuator 49 is in the position illustrated by solid lines in FIG. 4, the nut 54 can be rotatably tightened to bear against the side surface 56, thereby causing the opposed collar halves 43 and 44 to tightly grippingly engage the support rail 21 within the cylindrical opening 45. However, before the nut 54 is fully tightened against the side surface 56, and while slight clearance still exists between the support rail 21 and the cylindrical opening 45, the clamping collar can be slidably displaced longitudinally along the rail 21 so as to be positioned at the desired longitudinal location. The clamping collar can also be rotated generally about the axis of the support rail to angularly orient the clamp collar as desired.

Figure 4:
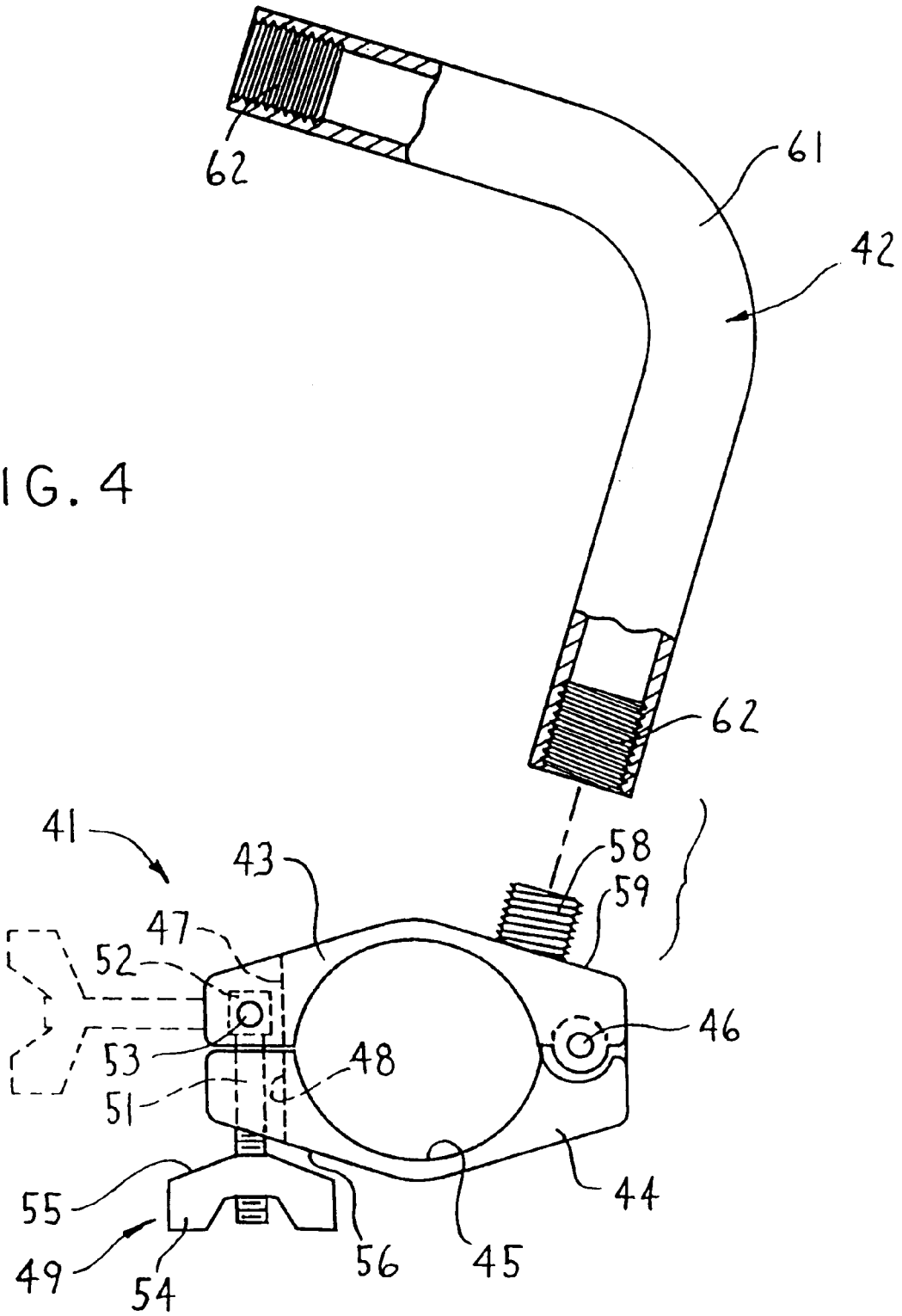
FIG. 4 is an enlarged but exploded side view illustrating the releasable clamp and the related support arm which comprise a common part of many of the different supporting devices.

When it is desired to either remove or mount the clamp collar 41 on the support rail 21, then the loosened actuator 49 is swingably moved out of the slot 48 into a position substantially as indicated by dotted lines in FIG. 4, which enables the collar halves 43 and 44 to be swingably moved about the hinge pin 46 into an opened position so as to be transversely movable relative to the support rail 21 either for positioning thereon or removal therefrom.

The clamp collar 41, and specifically the collar half 43, is also provided with a connecting element formed generally as a threaded stud 58 which is fixed to and projects outwardly from one of the side surfaces 59 of the collar half. The stud 58 is preferably positioned so as to be disposed substantially diametrically opposite from the clamp nut 54 so as to not interfere with access to or manipulation of the actuator 49.

The elongate support arm 42 is formed generally as an elongate tubular element 61 having threaded sockets 62 defined at each end thereof. The threaded socket 62 at one end of the tube 61 is threaded onto the stud 58 so as to join the support arm 42 to the releasable clamp 41. The elongate tube 61 defining the support arm 42 will typically be disposed in a bent configuration so that elongate arm parts disposed adjacent opposite ends thereof are in angled relationship to one other and joined through an intermediate curved portion, the arrangement as illustrated in FIG. 4 being generally L-shaped and incorporating an intermediate bend of about 90°. While the tube 61 can be constructed of a rigid tubular element if desired, nevertheless it is preferred that the tube 61 be a bendable or flexible element so as to permit the opposite ends thereof to be suitably disposed in a variable relative angular orientation, thereby providing the user with a greater degree of flexibility with respect to configuring and positioning the individual supporting devices. For this purpose the tube 61 is preferably a conventional flexible tube of the type conventionally provided on light fixtures and the like, such flexible tube being commonly known as a gooseneck-type bendable tube. Since such flexible tubes are well known and can be commercially purchased, further detailed description thereof is believed unnecessary.

The various and exemplary types of supporting devices 31–35 will now be described in greater detail.

Figure 5:
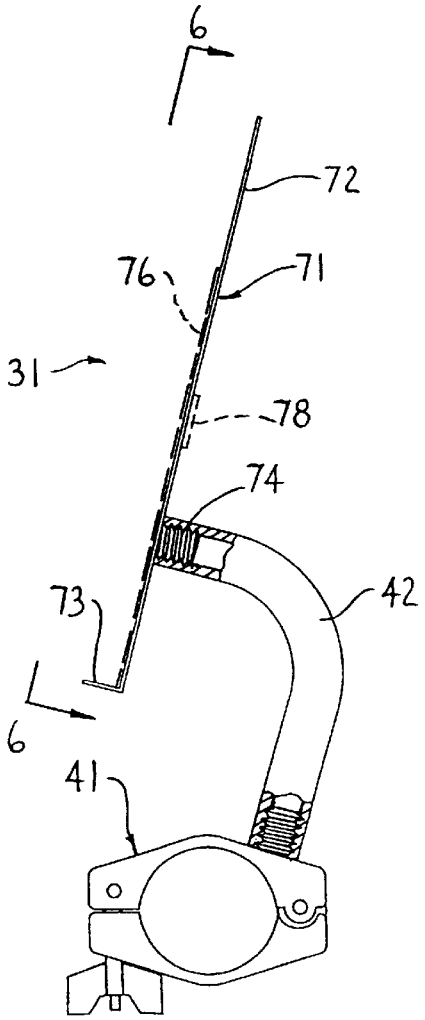
FIG. 5 is a side elevational view of one supporting device known as a holder.
Figure 6:
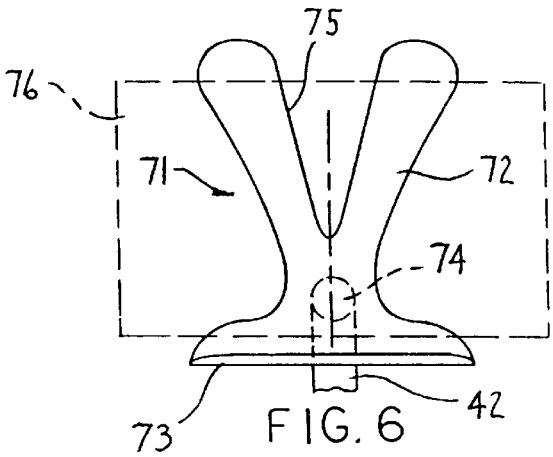
FIG. 6 is a view taken generally along line 6—6 in FIG. 5, and also illustrating a markerboard assembly in dotted lines.

Considering first the holder assembly 31 and referring to FIGS. 5 and 6, this holder device 31 includes a generally L-shaped holder member 71 defined by a generally elongated upright wall 72 which, at its lower edge, is fixedly, here integrally, joined to a bottom wall 73 which projects substantially perpendicularly outwardly from the front surface of the upright wall 72. The bottom wall 73 terminates in an outer free edge so that the bottom wall has a width, as measured between the outer free edge and the upright wall 72, which is only a small fraction of the overall height of the upright wall 72. In a typical embodiment, the upright wall 72 will typically have a height in the order of 10 to 14 inches so as to permit a typical sized document or paper to be positioned against the planar front surface thereof. The bottom wall 73 will typically have a width of no more than two to three inches so as to support the lower edge of the paper or document. The upright wall 72 is also provided with a connector, specifically a threaded stud 74, which projects from the rear surface thereof and is removably connectable to the socket 62 provided in the end of the support arm 42.

The L-shaped support member 71 is preferably formed from a thin sheetlike or platelike member, such as a metal or plastic member, whereby the member 71 is hence of light weight.

Due to the positional adjustability of the clamp 41 relative to the support rail 21, and the additional adjustability provided by use of a flexible or bendable connector arm 42, this enables the position of the L-shaped holder member 71 to be varied over a significant extent. For example, the holder 71 can be positioned substantially directly over, or horizontally rearwardly or forwardly spaced relative to the support rail 21. The position of the holder 71 can also be varied vertically by suitable positional adjustment of the collar 41 and support arm 42, and in addition the holder 71 can be disposed so as to be either in a generally upright arrangement as illustrated by FIG. 5, or the holder can be angularly tilted into an more rearwardly inclined position as illustrated by one of the devices shown in FIG. 1, thereby providing the user with a significant degree of flexibility with respect to how and where the holder assemblies 31 are positioned, oriented and used.

Figure 7:
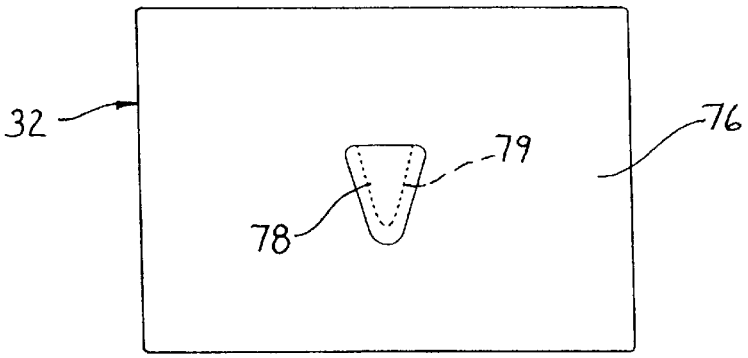
FIG. 7 is a rear view of the markerboard assembly.
Figure 8:
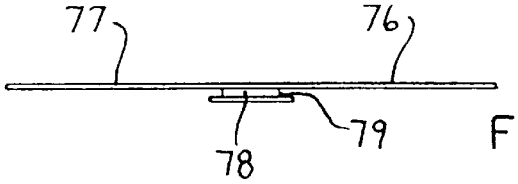
FIG. 8 is a top view of FIG. 7.

Considering now the markerboard assembly 32, same is used in conjunction with, and in fact mounts on, one of the holder assemblies 31. The markerboard assembly 32 (FIGS. 7 and 8) includes a generally thin but planar markerboard 76 which, in the illustrated embodiment, is of a generally rectangular configuration and is constructed of a conventional plastic or fiberglass material having a smooth planar front surface 77 suitable for use with erasable marking pens. The markerboard 76 has a V-shaped mounting hanger 78 fixed to and projecting outwardly from the rear surface thereof substantially at the middle thereof. This hanger 78 defines therein a generally downwardly-directed V-shaped undercut groove or slot 79.

To permit mounting of the markerboard 76, the L-shaped holder member 71 is preferably provided with a V-shaped slot 75 opening downwardly from an upper edge of the upright wall 72, which slot 75 extends generally along the central longitudinal axis of the upright wall and terminates at a closed lower end. The markerboard 76 is positioned so as to generally overlie the front side of the upright wall 72, with the V-shaped hanger 78 projecting rearwardly through the slot 75. The markerboard is then slidably moved downwardly along the slot 75 until the V-shaped hanger 78 seats within the bottom of the slot 75 due to the edge walls along the slot 75 projecting into the undercut groove 79. When so disposed, the markerboard 76 is positioned so as to substantially overlie and be engaged with the upright wall 72, and the lower edge of the markerboard is positioned closely adjacent the bottom wall 73. The user can readily mount the markerboard 76 on one of the holder members 71 when use thereof is desired, and the markerboard can be readily removed from the holder 71 when use thereof is no longer desired. The bottom wall or shelf 73 of the holder member 71 will function to support the erasable marking pens.

Considering now the clip assembly 33 and referring to FIGS. 9 and 10, this assembly includes a generally T-shaped clip 81 which has a construction and function similar to what is conventionally referred to as a potato chip clip. More specifically, the T-shaped clip 81 includes a pair of generally opposed and overlapping T-shaped clip members 82 each having an elongate base leg 83 joined at the middle thereof to a perpendicularly projecting stem leg 84. A hinge 85 couples the two T-shaped clip members 81 together in generally sidewardly spaced relation, which hinge 85 defines an axis which extends generally parallel to the elongate direction of the base legs 83, but is spaced intermediate the ends of the stem legs 84. The base legs 83, on the inner surfaces thereof, have elongate clamping strips 86 secured thereto in opposed relationship to one another, which clamping strips can be of a somewhat elastomeric or rubberlike material to facilitate gripping the edge of a paper or document therebetween. A spring 87 is also cooperatively engaged between the stem legs 84 to normally maintain the clip in a closed position wherein the clamping strips 86 are engaged with one another substantially as illustrated by FIG. 9. The T-shaped clip 81 is released in a conventional manner by manually gripping the free ends of the stem legs 84 and compressing them toward one another so as to pivotally move the clamping strips 86 away from one another in opposition to the urging of the spring 87.

The T-shaped clip 81 also has a connector, specifically a threaded stud 88, fixed to and projecting outwardly from the outer surface of one of the T members 82. This stud 88 is preferably mounted on and projects outwardly from the respective stem leg 84 at a location disposed in close proximity to the base leg 83. This threaded stud 88 is engageable with one end of the support arm 42, as illustrated, and as generally described above relative to the other supporting devices.

The clip assembly 33 can be readily mounted on or removed from the support rail 21, and the position of the clip assembly can be readily moved both vertically and horizontally relative to the support rail 21 so as to permit the clip assembly to be variably positioned either closer to or more rearwardly from the table top 12. Such adjustments are selectively chosen by the user by adjustably positioning the clamp 41 and the bendable support arm 42 in the same manner as discussed above.

The tray or dish assembly 34, as shown in FIG. 11, includes a generally concave upwardly opening dish 81, or alternatively a generally flat support tray 92 as indicated by dotted lines in FIG. 11. The dish 91 or tray 92 is provided with a connector, specifically a threaded stud 93, projecting centrally from the underside thereof, and this stud in turn is engaged within one end of the support arm 42 in the same manner as described above. With use of the dish 91 or tray 92, the collar 41 and support arm 42 will typically be oriented and adjusted so that the dish 91 or tray 92 faces generally upwardly to permit stable support of objects or things thereon. However, the height of the tray or dish, and the front-to-back positioning thereof relative to the support rail, can obviously be adjusted by suitable positioning of the collar 41 and support arm 42.

Considering lastly the hanging rail assembly 35, and referring to FIGS. 1 and 2, this assembly includes a pair of generally elongate and upright arms or rods 96 which, at their lower ends, are each threadedly engaged with a separate clamping collar 41. The arms 96 at their upper ends are joined by a horizontally elongate hanging rail 97 which is fixedly, but preferably releasably, joined at opposite ends thereof to upper ends of the upright rods 96. Such may be achieved in many different and conventional manners. For example, the free ends of rail 97 may be provided with transversely projecting pins which project into sockets formed in the upper ends of upright rods 96, which pins can be fixed in the sockets by set screws or the like if desired. The upright rods 96 are preferably provided with a rear-projecting curvature so as to not interfere with the vertical space disposed generally directly above the support rail 21. These upright support rods 96 also project vertically upwardly a substantial extent, particularly to an elevation substantially above the uppermost point of the other supporting devices 31–34, whereby the hanging rail 97 is positioned at an elevation whereby relatively large documents such as drawings or the like can be clipped to the hanging rail 79 for suspension downwardly therefrom. Generally downwardly-opening U-shaped spring clips (not shown) can be provided for releasable engagement with the hanging rail 97, which clips will permit an upper edge of a drawing or document to be frictionally held between the rail 97 and the spring clip.

While not illustrated in the drawings, it will be appreciated that the clamp 41 and support arm 42 can also be used to mount a light fixture on the free end of the support arm, which light fixture can be suitably positioned and directed by the user so as to provide accent or additional lighting for selected areas or regions as deemed necessary or desirable. The electrical cord for the light fixture will merely hang downwardly and be plugged into any conveniently available electrical outlet.

The overall use and adjustment of the spacial work-in-progress organizer, and the advantages thereof, is believed apparent from the description presented above, and further detailed description thereof is believed unnecessary.

While the invention illustrated and described above, and in accordance with a preferred embodiment hereof, relates to a spacial organizer which is formed of a horizontally arcuate configuration, it will be appreciated that the organizer can assume many other configurations and in fact can be horizontally straight for cooperation along a straight edge of a table top or desk, if desired. The organizer 10 can also be used by itself without being positioned for use in conjunction with an adjacent table top or worksurface, although it is believed that the most common and efficient use of the organizer 10 will be its use in conjunction with some other type of worksurface, such as a table.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A spacial organizer for use in an office to permit display and organization of documents and the like, said organizer comprising:

a horizontally and longitudinally elongate support rail, and a supporting structure engaged with said support rail and projecting downwardly therefrom for engagement with the floor to maintain the support rail in upwardly spaced relation above the floor;

a plurality of supporting devices removably mounted on said support rail longitudinally therealong for permitting documents and things to be removably positioned thereon; and a table top positioned adjacent said support rail but spaced therefrom, said support rail being positioned in horizontally outwardly and vertically upwardly spaced relation from an elongate edge of said table top, said elongate edge having a generally arcuate configuration in a horizontal plane, and said support rail also having an arcuate configuration in a horizontal plane so that said support rail, when viewed in a horizontal plane, extends longitudinally in approximately parallel relationship to said elongate edge.

2. A spacial organizer according to claim 1 wherein said plurality of supporting devices includes a generally L-shaped handling member configured to removably support thereon a document or paper in a generally upright manner.

3. A spacial organizer according to claim 2 further including a markerboard assembly removably mounted on said handling member, said markerboard assembly including a generally planar markerboard having a surface adapted for use with erasable-type marking pens.

4. A spacial organizer according to claim 3 wherein said handling member includes an upright wall having a slot disposed therein, a bottom wall joined to said upright wall at a lower edge thereof and being oriented transversely with respect to said upright wall, and said markerboard assembly including a mounting member which projects rearwardly from said markerboard and engages in said slot of said upright wall.

5. A spacial organizer according to claim 1 wherein said plurality of supporting devices includes at least one of: a spring clip for engaging an edge of a paper or document; a generally concave tray for supporting objects thereon; and a hanging rail having an inverted U-shaped configuration and adapted for supporting large documents in a suspended manner therefrom.

6. A spacial organizer according to claim 1 wherein each said supporting device includes an elongate support arm having a clamping arrangement at one end thereof for releasable engagement with said support rail, said support arm projecting transversely away from said support rail and being adjustable both horizontally and vertically with respect to said support rail.

7. A spacial organizer according to claim 6 wherein said elongate support arm includes a flexible and bendable tube adapted to permit positioning of the respective supporting device in a plurality of positions with respect to said support rail and said table top, said clamping arrangement includes a clamp having an opening therein through which a portion of said support rail extends, and said clamp includes means for permitting rotational adjustment of said supporting device with respect to said support rail and horizontal adjustment of said supporting device lengthwise along said support rail.

8. A spacial organizer according to claim 1 wherein said table top includes a supporting structure projecting downwardly therefrom for engagement with the floor to maintain said table top in upwardly spaced relation above the floor, said supporting structure of said table top being separate from said supporting structure of said support rail such that said table top and said support rail are individually movable and positionable relative to one another.

9. A spacial organizer for use in an office to permit display and organization of documents and the like, said organizer comprising:

a horizontally and longitudinally elongate support rail, and a supporting structure engaged with said support rail and projecting downwardly therefrom for engagement with the floor to maintain the support rail in upwardly spaced relation above the floor;

a plurality of supporting devices removably mounted on said support rail longitudinally therealong for permitting documents and things to be removably positioned thereon;

said plurality of supporting devices including a first supporting assembly having a generally L-shaped handling member which permits a document or paper to be removably supported thereon in a generally upright position;

said plurality of supporting devices including a second supporting assembly which includes a spring clip for engaging an edge of a paper or document;

said supporting devices each including an elongate support arm assembly which at one end has a clamp structure for releasable engagement with the support rail, said elongate support arm projecting transversely away from the support rail and being positionally adjustable relative to the support rail to permit both the horizontal and vertical position thereof to be varied; and a table top positioned adjacent said support rail but separated therefrom, said support rail being positioned in horizontally outwardly and vertically upwardly spaced relation from an elongate edge of said table top;

said elongate edge of said table top having a generally arcuate convex configuration in a horizontal plane, and said support rail also having an arcuate configuration in a horizontal plane so that the support rail, when viewed in a horizontal plane, extends longitudinally in approximately parallel relationship to said elongate edge of said table top.

* * * * *